US009302461B2

(12) United States Patent
Kamoda et al.

(10) Patent No.: US 9,302,461 B2
(45) Date of Patent: Apr. 5, 2016

(54) PROOF PRINTING PRESS

(71) Applicant: KOMORI CORPORATION, Tokyo (JP)

(72) Inventors: Hiroyoshi Kamoda, Tsukuba (JP); Akehiro Kusaka, Tsukuba (JP); Heisuke Onoue, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/452,610

(22) Filed: Aug. 6, 2014

(65) Prior Publication Data

US 2015/0040784 A1 Feb. 12, 2015

(30) Foreign Application Priority Data

Aug. 7, 2013 (JP) ..... 2013-163855

(51) Int. Cl.

| | |
|---|---|
| ***B41F 9/08*** | (2006.01) |
| ***B41F 9/04*** | (2006.01) |
| ***B41F 9/00*** | (2006.01) |
| ***B41F 9/06*** | (2006.01) |
| ***B41F 31/30*** | (2006.01) |
| ***B41F 33/10*** | (2006.01) |

(52) U.S. Cl.

CPC . *B41F 9/04* (2013.01); *B41F 9/002* (2013.01); *B41F 9/063* (2013.01); *B41F 31/301* (2013.01); *B41F 33/10* (2013.01)

(58) Field of Classification Search

CPC ..... B41F 9/04
USPC ..... 101/155
See application file for complete search history.

(56) References Cited

U.S. PATENT DOCUMENTS 2,659,305 A * 11/1953 Giori ..... B41F 11/00 101/152
3,898,929 A * 8/1975 Arild et al. ..... 101/147
4,056,056 A * 11/1977 Giori ..... 101/152

(Continued)

FOREIGN PATENT DOCUMENTS

EP 0 406 157 A1 1/1991
EP 0 563 007 A1 9/1993

(Continued)

OTHER PUBLICATIONS

Extended European Search Report dated Feb. 19, 2015 issued in Application No. EP 14179975.9.

*Primary Examiner* — Anthony Nguyen
(74) *Attorney, Agent, or Firm* — Birch, Stewart, Kolasch & Birch, LLP

(57) ABSTRACT

In a proof printing press, a length of an outer circumference of a plate cylinder at a downstream side of a facing position P1 in a rotation direction is longer than a length in a circumferential direction of a mounting surface of the plate cylinder, where the length of the outer circumference of the plate cylinder extends between the facing position P1 where the plate cylinder faces a collecting cylinder and a facing position P2 where the plate cylinder faces a wiping roller, and a length of the outer circumference of the plate cylinder at a downstream side of the facing position P2 is longer than the length in the circumferential direction of the mounting surface of the plate cylinder, where the length of the outer circumference of the plate cylinder extends between the facing position P2 and a facing position P3 where the plate cylinder faces an impression cylinder.

6 Claims, 9 Drawing Sheets

(56) References Cited

U.S. PATENT DOCUMENTS 5,062,359 A * 11/1991 Giori ..... B41F 9/02 101/152
5,282,417 A * 2/1994 Germann ..... B41F 9/02 101/152
2005/0028693 A1* 2/2005 Aoki ..... B41F 9/1018 101/155
2006/0162591 A1* 7/2006 Schaede ..... 101/152
2008/0295724 A1* 12/2008 Lohweg et al. ..... 101/484

FOREIGN PATENT DOCUMENTS

JP 6-39990 A 2/1994
JP 6-47724 Y2 12/1994

* cited by examiner

PROOF PRINTING PRESS

TECHNICAL FIELD

The present invention relates to a proof printing press configured to perform proof printing.

BACKGROUND ART

In some cases where intaglio printing, for example, is performed on a sheet using an intaglio printing press, proof printing for checking the printed state is performed before the intaglio printing. In a proof printing press configured to perform such proof printing, while an impression cylinder holds sheets one by one, ink of each color supplied from each ink supply device to each chablon cylinder is transferred from the chablon cylinder to a collecting cylinder and then transferred to an intaglio printing plate surface of a plate cylinder. After a wiping roller removes extra ink on the intaglio printing plate surface of the plate cylinder, the ink supplied into a recessed portion of the intaglio printing plate of the plate cylinder is transferred to the sheet held on the impression cylinder. After that, the sheet is released from the impression cylinder. In this manner, proof printing can be performed on a sheet (see, for example, Patent Literature 1 and the like below).

CITATION LIST

Patent Literatures

{Patent Literature 1} Japanese Patent Application Publication No. Hei 6-039990

{Patent Literature 2} Japanese Examined Utility Model Registration Application Publication No. Hei 6-047724

SUMMARY OF INVENTION

Technical Problem

In a conventional proof printing press as described above, when the ink is transferred from the collecting cylinder to the intaglio printing plate of the plate cylinder, or when the ink is transferred from the intaglio printing plate of the plate cylinder to the sheet on the impression cylinder, the wiping roller removes extra ink on the surface of the intaglio printing plate of the plate cylinder. In this event, the pressing force of the wiping roller against the plate cylinder serves as a disturbance, which causes uneven transfer onto a sheet, resulting in printing failure in some cases.

Accordingly, an object of the present invention is to provide a proof printing press capable of reducing uneven transfer onto a sheet and thereby reducing printing failure.

Solution to Problem

To achieve the above-described object, a proof printing press according to the present invention provides a proof printing press including: a plate cylinder rotatably supported and including, on an outer circumference thereof, a working surface on which an intaglio printing plate is mounted; an impression cylinder rotatably supported to face the plate cylinder and including, on an outer circumference thereof, a working surface configured to a hold sheet; a collecting cylinder rotatably supported to face the plate cylinder and including, on an outer circumference thereof, a working surface on which a blanket is mounted; multiple chablon cylinders disposed along a circumferential direction of the collecting cylinder, rotatably supported to face the collecting cylinder, and including, on outer circumferences thereof, working surfaces on which segment plates are mounted; multiple form rollers rotatably supported to face the chablon cylinders, respectively; multiple ink supplying means for supplying inks to the form rollers, respectively; and wiping means disposed to face the plate cylinder between a facing position where the plate cylinder faces the collecting cylinder and a facing position where the plate cylinder faces the impression cylinder, the wiping means being for removing ink on a surface of the intaglio printing plate of the plate cylinder. The plate cylinder has a size of a multiple cylinder large enough to mount thereon the multiple intaglio printing plates aligned in the circumferential direction, while the number of the working surface is only one. The chablon cylinders are single-size cylinders. The chablon cylinders rotate multiple times, while the plate cylinder rotates once. The proof printing press is characterized as follows. The impression cylinder, the collecting cylinder, and the wiping means are positioned relative to the plate cylinder such that a length of the outer circumference of the plate cylinder at a downstream side of the facing position P1 in a rotation direction of the plate cylinder is longer than a length in a circumferential direction of the working surface of the plate cylinder, where the length of the outer circumference of the plate cylinder extends between the facing position P1 where the plate cylinder faces the collecting cylinder and a facing position P2 where the plate cylinder faces the wiping means, and that a length of the outer circumference of the plate cylinder at a downstream side of the facing position P2 in the rotation direction of the plate cylinder is longer than a length in the circumferential direction of the working surface of the plate cylinder, where the length of the outer circumference of the plate cylinder extends between the facing position P2 where the plate cylinder faces the wiping means and the facing position P3 where the plate cylinder faces the impression cylinder. Rotation phases of the collecting cylinder and the chablon cylinders are set such that an end portion at a downstream side in a rotation direction of the working surface of the collecting cylinder and an end portion at a downstream side in a rotation direction of each of the working surfaces of the chablon cylinders rotate in synchronism and in contact with each other in accordance with rotations of the collecting cylinder and the chablon cylinders. A length in a circumferential direction of the outer circumferential surfaces of the form rollers is equal to a length in a circumferential direction of the working surfaces of the chablon cylinders.

Moreover, the proof printing press according to the present invention provides the above-described proof printing press characterized in that as follows. Five of the chablon cylinders are disposed along the circumferential direction of the collecting cylinder. The chablon cylinders are positioned such that a length of the outer circumference of the collecting cylinder at the downstream side of the facing position P1 in the rotation direction of the collecting cylinder is longer than a length in the circumferential direction of the working surface of the collecting cylinder, where the length of the outer circumference of the collecting cylinder extends between the facing position P1 where the plate cylinder faces the collecting cylinder and a facing position P4 where the collecting cylinder faces the chablon cylinder located at the most upstream side of the facing position P1 in the rotation direction of the collecting cylinder, and that a length of the outer circumference of the collecting cylinder at an upstream side of the facing position P1 in the rotation direction of the collecting cylinder is longer than the length in the circumferential direction of the working surface of the collecting cylinder, where the length of the outer circumference of the collecting cylinder extends between the facing position P1 where the plate cylinder faces the collecting cylinder and a facing position P5 where the collecting cylinder faces the chablon cylinder located at the most downstream side of the facing position P1 in the rotation direction of the collecting cylinder.

Moreover, the proof printing press according to the present invention provides the above-described proof printing press characterized by including: at least one detecting means of position detecting means and phase detecting means; and controlling means. The position detecting means detects at least one position of a rotation direction position of the working surface of the plate cylinder, a rotation direction position of the working surface of the collecting cylinder, and a position of the sheet fed to the impression cylinder. The phase detecting means detects a phase of the printing press. The controlling means controls ink supply from the ink supplying means on the basis of information from the detecting means in such a manner that when the end portions at the downstream sides in the rotation directions of the working surfaces of the chablon cylinders face the form rollers, the inks are supplied to the outer circumferential surfaces of the form rollers between upstream sides of positions facing the chablon cylinders in rotation directions of the form rollers and downstream sides of ink supply positions from the ink supplying means in the rotation directions of the form rollers.

Moreover, the proof printing press according to the present invention provides the above-described proof printing press characterized as follows. The form rollers are supported in such a manner as to be movable toward and away from the chablon cylinders. The ink supplying means include fountain rollers rotatably supported in such a manner as to be movable toward and away from the form rollers and configured to supply inks in ink fountains to the form rollers. The proof printing press includes: form-roller-rotation driving means for rotating the form rollers; form-roller-throw-on/off driving means for moving the form rollers toward and away from the chablon cylinders; fountain-roller-rotation driving means for rotating the fountain rollers; and fountain-roller-throw-on/off driving means for moving the fountain rollers toward and away from the form rollers. The detecting means includes at least the phase detecting means. The controlling means controls the fountain-roller-throw-on/off driving means in such a manner that the fountain rollers are brought into contact with the form rollers, and controls the form-roller-rotation driving means and the form-roller-rotation driving means in such a manner that the fountain rollers and the form rollers are rotated, on the basis of information from the phase detecting means, so that when the end portions at the downstream sides in the rotation directions of the working surfaces of the chablon cylinders face the form rollers, inks are supplied to the outer circumferential surfaces of the form rollers between the upstream sides of the positions facing the chablon cylinders in the rotation directions of the fountain rollers and downstream sides of positions facing the fountain rollers in the rotation directions of the form rollers. The controlling means controls the form-roller-throw-on/off driving means in such a manner that the form rollers are brought into contact with the segment plates on the working surfaces of the chablon cylinders, on the basis of information from the phase detecting means when the end portions at the downstream sides in the rotation directions of the working surfaces of the chablon cylinders face the form rollers. The controlling means controls the fountain-roller-throw-on/off driving means in such a manner that the fountain rollers are moved away from the form rollers, on the basis of information from the phase detecting means upon completion of one rotation of the form rollers after the form rollers start being supplied with the inks. The controlling means controls the form-roller-throw-on/off driving means in such a manner that the form rollers are moved away from the chablon cylinders, and simultaneously controls the form-roller-rotation driving means in such a manner that the rotations of the form rollers are stopped, on the basis of information from the phase detecting means upon completion of one rotation after the form rollers are brought into contact with the segment plates on the working surfaces of the chablon cylinders.

Moreover, the proof printing press according to the present invention provides the above-described proof printing press characterized as follows. The proof printing press includes sheet feeding means for supplying the sheet to the impression cylinder. The controller controls the sheet feeding means in such a manner that the sheet is fed to the impression cylinder, on the basis of information from the phase detecting means after the inks are transferred the chablon cylinders to the blanket of the collecting cylinder and the inks are transferred from the blanket of the collecting cylinder to the intaglio printing plates on the working surface of the plate cylinder.

Moreover, the proof printing press according to the present invention provides the above-described proof printing press characterized as follows. The controller controls the fountain-roller-throw-on/off driving means in such a manner that the fountain rollers are brought into contact with the form rollers again, and controls the form-roller-rotation driving means and the fountain-roller-rotation driving means in such a manner that the fountain rollers and the form rollers are rotated again, on the basis of information from the phase detecting means, so that when the inks transferred from the chablon cylinders to the blanket on the collecting cylinder are completely transferred from the blanket on the collecting cylinder to the intaglio printing plates on the working surface of the plate cylinder and then the end portions at the downstream sides in the rotation directions of the working surfaces of the chablon cylinders face the form rollers again, inks are again supplied to the outer circumferential surfaces of the form rollers between the upstream sides of the positions facing the chablon cylinders in the rotation directions of the form rollers and the downstream sides of the positions facing the fountain rollers in the rotation directions of the form rollers. The controller controls the form-roller-throw-on/off driving means in such a manner that the form rollers are again brought into contact with the segment plates on the working surfaces of the chablon cylinders, on the basis of information from the phase detecting means when the end portions at the downstream sides in the rotation directions of the working surfaces of the chablon cylinders face the form rollers. The controller controls the fountain-roller-throw-on/off driving means in such a manner that the fountain rollers are moved away from the form rollers again, on the basis of information from the phase detecting means upon completion of one rotation of the form rollers after the form rollers again start being supplied with the inks. The controller controls the form-roller-throw-on/off driving means in such a manner that the form rollers are moved away from the chablon cylinders again, and simultaneously controls the form-roller-rotation driving means in such a manner that the rotations of the form rollers are stopped again, on the basis of information from the phase detecting means upon completion of one rotation after the form rollers are again brought into contact with the segment plates on the working surfaces of the chablon cylinders.

Advantageous Effects of Invention

In the proof printing press according to the present invention, the wiping means is not in contact with the intaglio printing plates on the plate cylinder while inks are transferred from the blanket on the collecting cylinder to the intaglio printing plates on the plate cylinder. Accordingly, it is possible to prevent a disturbance to the intaglio printing plate, and the inks can be transferred evenly from the blanket to the intaglio printing plate. In addition, after the wiping means removes all extra inks on the surfaces of the intaglio printing plate on the plate cylinder, the intaglio printing plate on the plate cylinder come into contact with a sheet held on the working surface of the impression cylinder to transfer the inks. Accordingly, when the inks are transferred from the intaglio printing plates on the plate cylinder to the sheet, it is possible to prevent a disturbance to the intaglio printing plates, and the inks can be transferred evenly from the intaglio printing plates to the sheet. This makes it possible to reduce uneven transfer onto a sheet and thereby reduce printing failure.

DESCRIPTION OF EMBODIMENTS

Embodiments of a proof printing press according to the present invention will be described based on the drawings. However, the present invention is not limited only to the embodiments described below based on the drawings.

Main Embodiment

A main embodiment of the proof printing press according to the present invention will be described below based on FIGS. 1, 2, and 3A to 3N.

Figure 1:
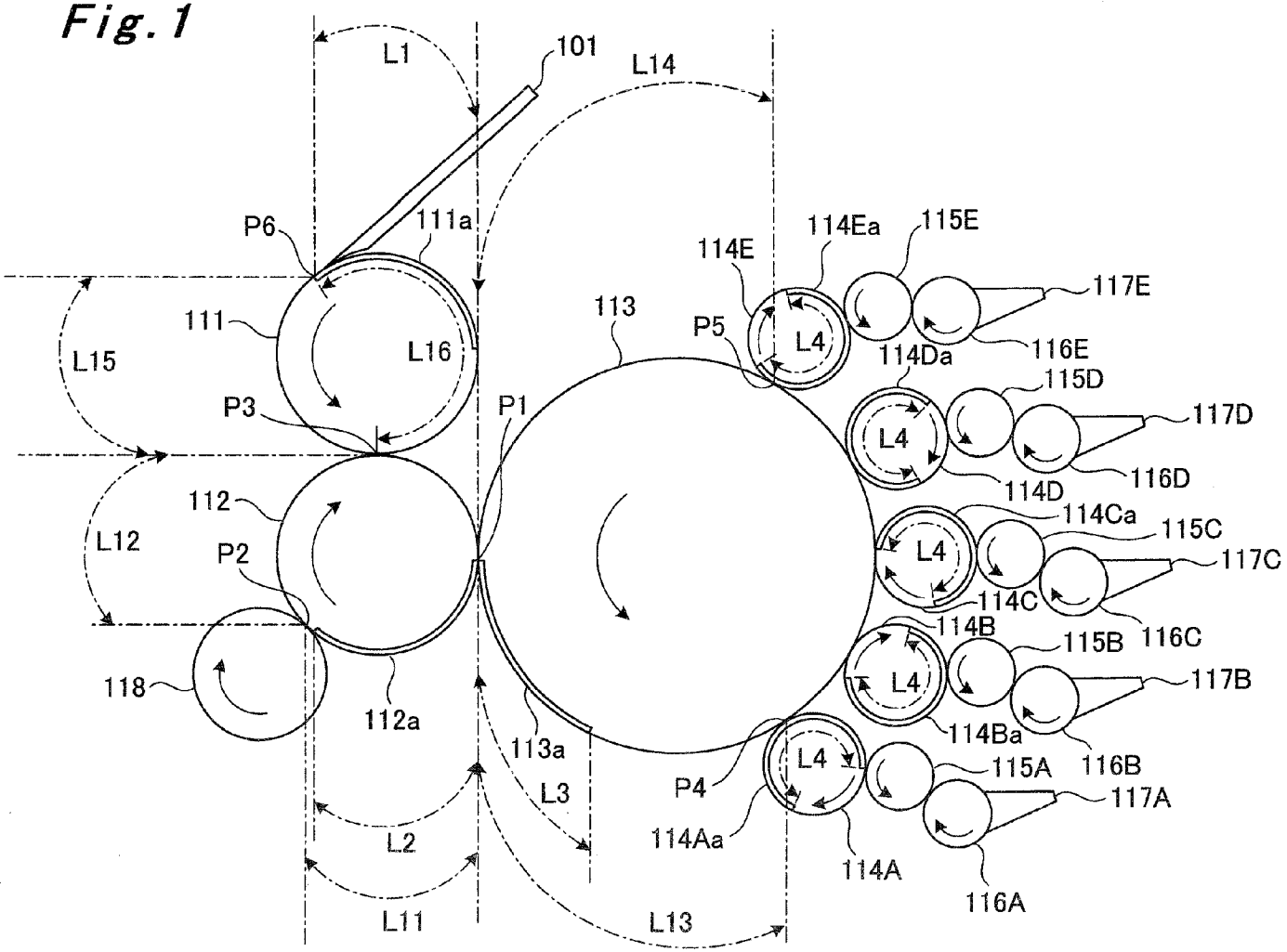
FIG. 1 shows a schematic configuration diagram of a main embodiment of a proof printing press according to the present invention.

As shown in FIG. 1, an impression cylinder 111 is rotatably disposed at a forward edge side of a sheet feed table 101 of a sheet feed device that is sheet feeding means for feeding sheets one by one. The impression cylinder 111 includes only one holding surface (working surface) 111*a* on an outer circumference thereof, the holding surface (working surface) 111*a* having a length L1 in a circumferential direction and configured to hold the sheet. The impression cylinder 111 has a grip device (not shown) configured to hold the sheet on the holding surface (working surface) 111*a* by gripping a forward edge side (gripping side) of the sheet, and is set to have such a diameter that the impression cylinder 111 has a size large enough to hold two sheets aligned in the circumferential direction, in other words, a size of a so-called "double-size cylinder."

A plate cylinder 112 is rotatably disposed to face the impression cylinder 111. The plate cylinder 112 includes only one mounting surface (working surface) 112*a* on an outer circumference thereof, the mounting surface (working surface) 112*a* having a length L2 (=L1) in a circumferential direction on which an intaglio printing plate is mounted. The plate cylinder 112 is set to have such a diameter that the plate cylinder 112 has a size large enough to mount thereon two intaglio printing plates described above aligned in the circumferential direction, in other words, a size of a so-called "double-size cylinder."

A collecting cylinder 113 is rotatably disposed to face the plate cylinder 112. The collecting cylinder 113 is a collecting cylinder including only one mounting surface (working surface) 113*a* on an outer circumference thereof, the mounting surface (working surface) 113*a* having a length L3 (=L1) in a circumferential direction on which a rubber-made blanket is mounted. The collecting cylinder 113 is set to have such a diameter that the collecting cylinder 113 has a size large enough to mount thereon four blankets described above in the circumferential direction, in other words, a size of a so-called "quadruple-size cylinder."

Multiple (five in the present embodiment) chablon cylinders 114A to 114E are rotatably disposed to face the collecting cylinder 113, at predetermined intervals along the circumferential direction of the collecting cylinder 113. The chablon cylinders 114A to 114E include only one of corresponding mounting surfaces (working surfaces) 114Aa to 114Ea on outer circumferences thereof, the mounting surfaces (working surfaces) 114Aa to 114Ea each having a length L4 (=L1) in a circumferential direction on which a resin-made segment plate is mounted. The chablon cylinders 114A to 114E are set to have such diameters that the chablon cylinders 114A to 114E each have a size large enough to install corresponding one of the mounting surfaces (working surfaces) 114Aa to 114Ea in the circumferential direction, in other words, a size of a so-called "single cylinder (single-size cylinder)."

Form rollers 115A to 115E are rotatably disposed to face the chablon cylinders 114A to 114E, respectively. The form rollers 115A to 115E are each set to have such a diameter that a length L5 in a circumferential direction of an outer circumferential surface thereof is equal to the length L4 in the circumferential direction of the mounting surfaces (working surfaces) 114Aa to 114Ea of the chablon cylinders 114A to 114E (L5=L4 (=L1)).

Fountain rollers 116A to 116E are rotatably disposed to face the form rollers 115A to 115E, respectively. The fountain rollers 116A to 116E are each set to have such a diameter that a length L6 in a circumferential direction of an outer circumferential surface thereof is equal to the length L5 in the circumferential direction of the form rollers 115A to 115E (L6=L5 (=L4=L1)). The fountain rollers 116A to 116E are respectively provided with ink fountains 117A to 117E configured to store inks.

A wiping roller 118 is rotatably disposed to face an outer circumferential surface of the plate cylinder 112, the outer circumferential surface located between a downstream side of a facing position P1 where the plate cylinder 112 faces the collecting cylinder 113 in a rotation direction of the plate cylinder 112 and an upstream side of a facing position P3 where the plate cylinder 112 faces the impression cylinder 111 in the rotation direction of the plate cylinder 112. The wiping roller 118 is configured to remove ink on the surfaces of the intaglio printing plates of the plate cylinder 112.

Moreover, the impression cylinder 111, the plate cylinder 112, the collecting cylinder 113, and the chablon cylinders 114A to 114E are connected to one another via a gear train in such a manner as to be rotatable in synchronism with one another. The plate cylinder 112 is provided with a rotary encoder 131 (see FIG. 2) that is phase detecting means for detecting a rotation phase of the plate cylinder 112, in other words, detecting rotation phases of the cylinders 111 to 113 and 114A to 114E, to put it differently, detecting a phase of the printing press.

Figure 3A:
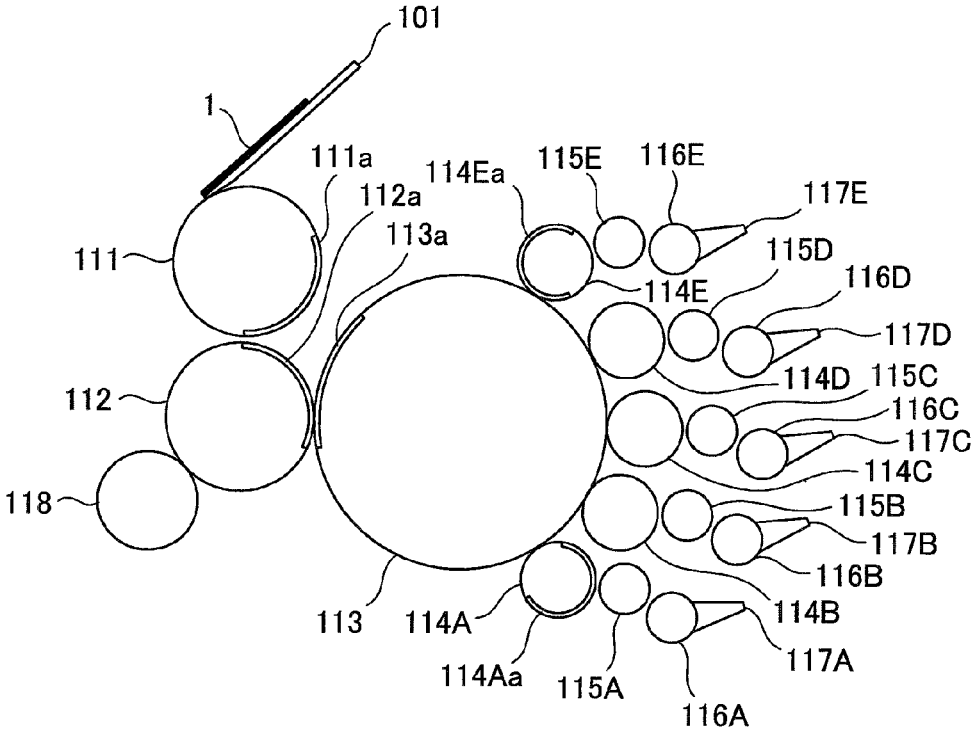
FIG. 3A shows a diagram for explaining the operation of the proof printing press shown in FIG. 1.

Further, as shown in FIG. 3A, the fountain rollers 116A to 116E are supported in such a manner as to be movable toward and away (thrown on/off) from the form rollers 115A to 115E. The ink fountains 117A to 117E are supported in such a manner as to be integrally movable in accordance with the above-described movements of the fountain rollers 116A to 116E. The form rollers 115A to 115E are supported in such a manner as to be movable toward and away (thrown on/off) from the chablon cylinders 114A to 114E (for example, the mechanism described in Patent Literature 2).

Furthermore, the impression cylinder 111 is supported by an eccentric bearing or the like in such a manner as to be movable toward and away (thrown on/off) from the plate cylinder 112. The sheet feed device including the sheet feed table 101 and the like is supported movably in such a manner as to follow a movement of the impression cylinder 111.

Figure 3B:
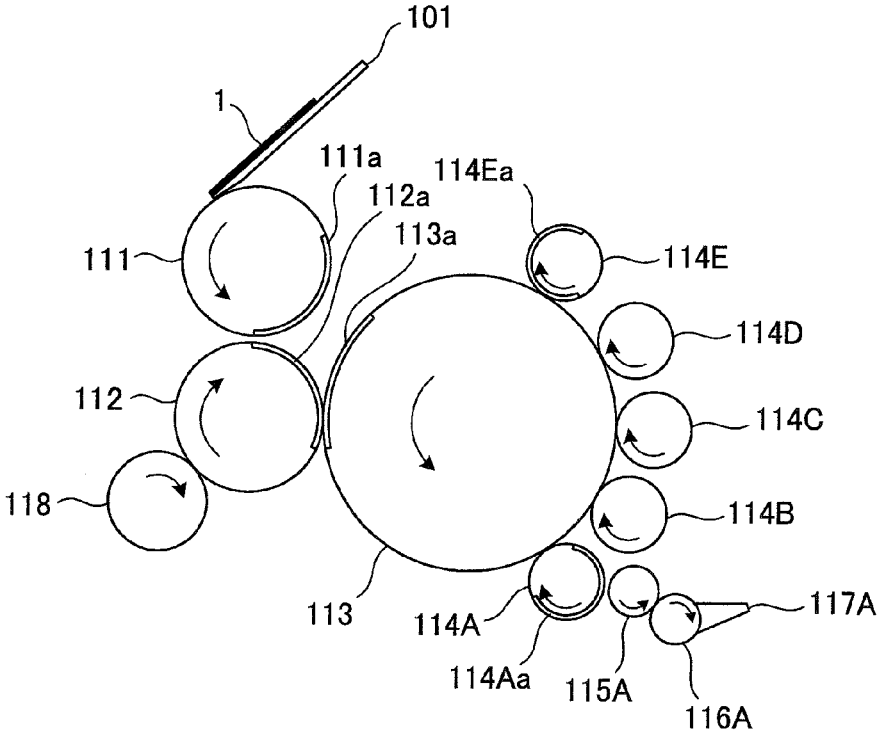
FIG. 3B shows a diagram for explaining the operation after FIG. 3A.
Figure 3C:
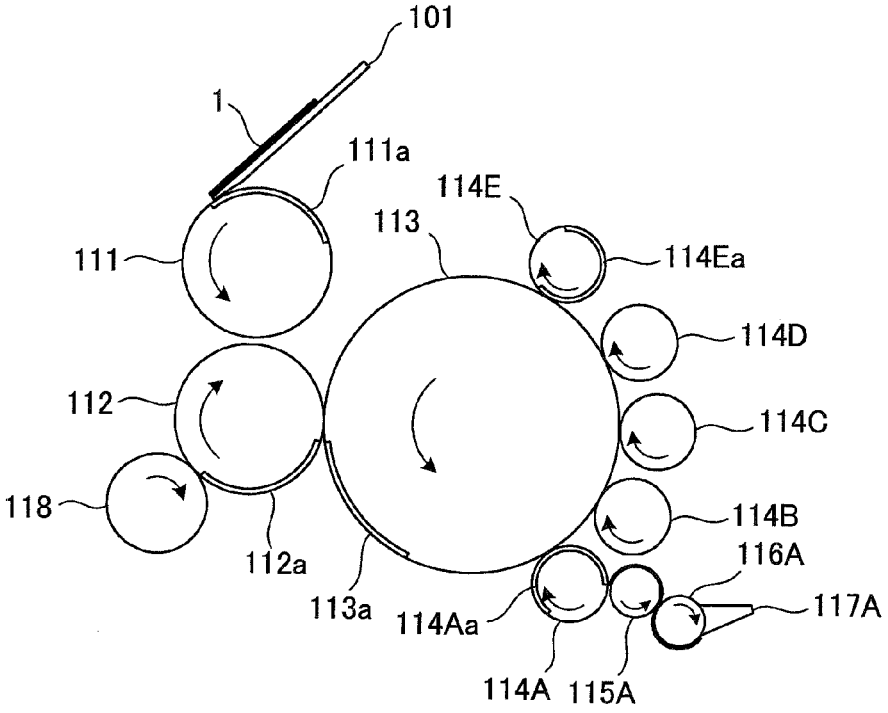
FIG. 3C shows a diagram for explaining the operation after FIG. 3B.
Figure 3D:
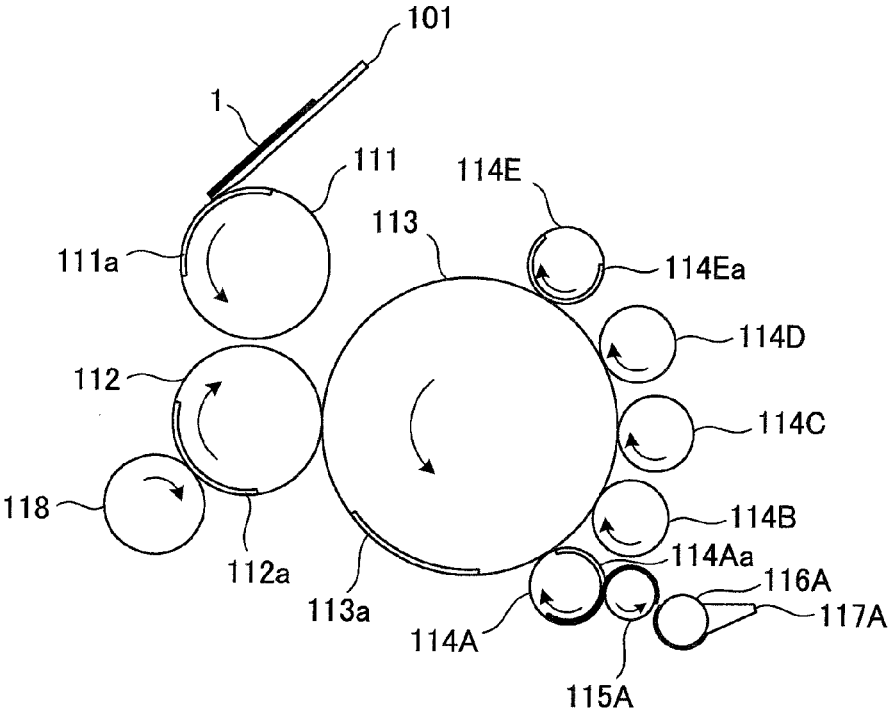
FIG. 3D shows a diagram for explaining the operation after FIG. 3C.
Figure 3E:
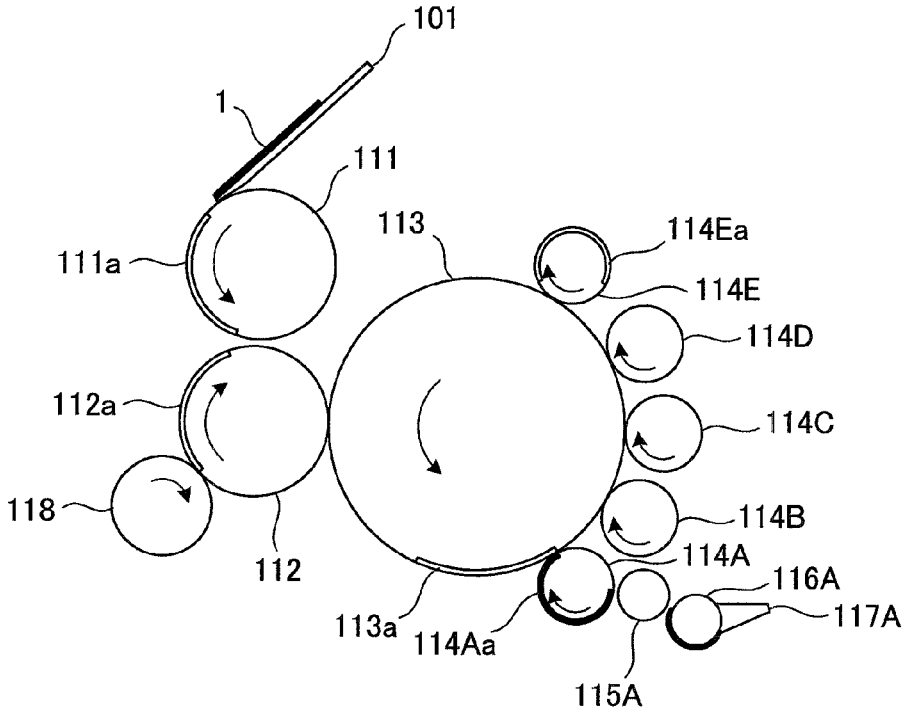
FIG. 3E shows a diagram for explaining the operation after FIG. 3D.

In addition, the rotation phases of the chablon cylinders 114A to 114E and the collecting cylinder 113 are set such that when the mounting surfaces (working surfaces) 114Aa to 114Ea and 113*a* face each other in accordance with the rotations, the chablon cylinders 114A to 114E and the collecting cylinder 113 rotate in synchronism and in contact with each other, in other words, an end portion at a downstream side in a rotation direction of the mounting surface (working surface) 113*a* of the collecting cylinder 113 and an end portion at a downstream side in a rotation direction of each of the mounting surfaces (working surfaces) 114Aa to 114Ea of the chablon cylinders 114A to 114E rotate in synchronism and in contact with each other (see FIG. 3E). Hence, the chablon cylinders 114A to 114E and the collecting cylinder 113 are not in contact with each other unless the mounting surfaces (working surfaces) 114Aa to 114Ea and 113*a* face each other.

Figure 3F:
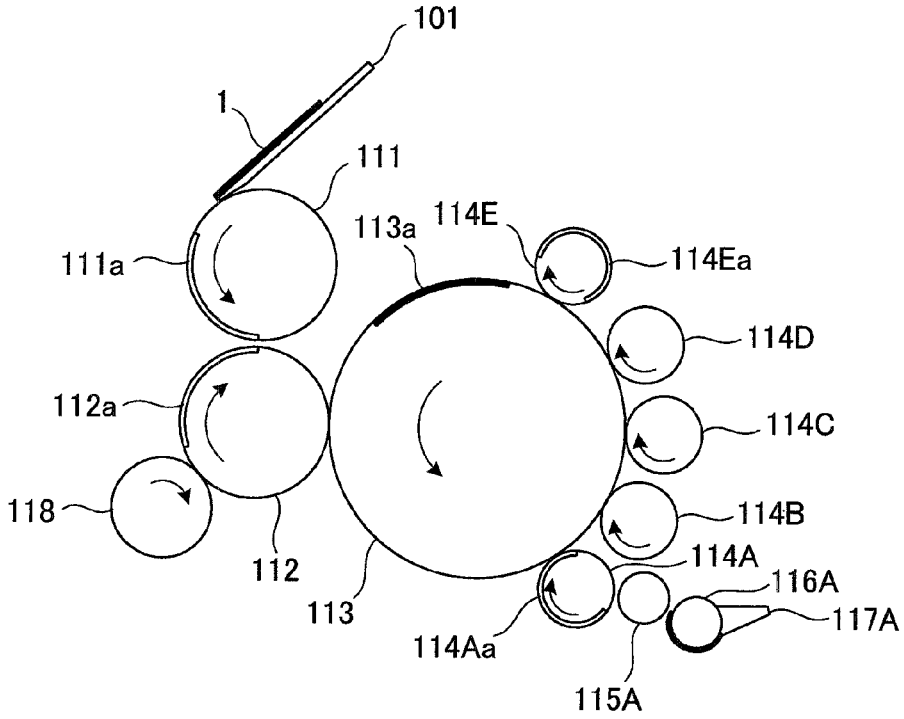
FIG. 3F shows a diagram for explaining the operation after FIG. 3E.
Figure 3G:
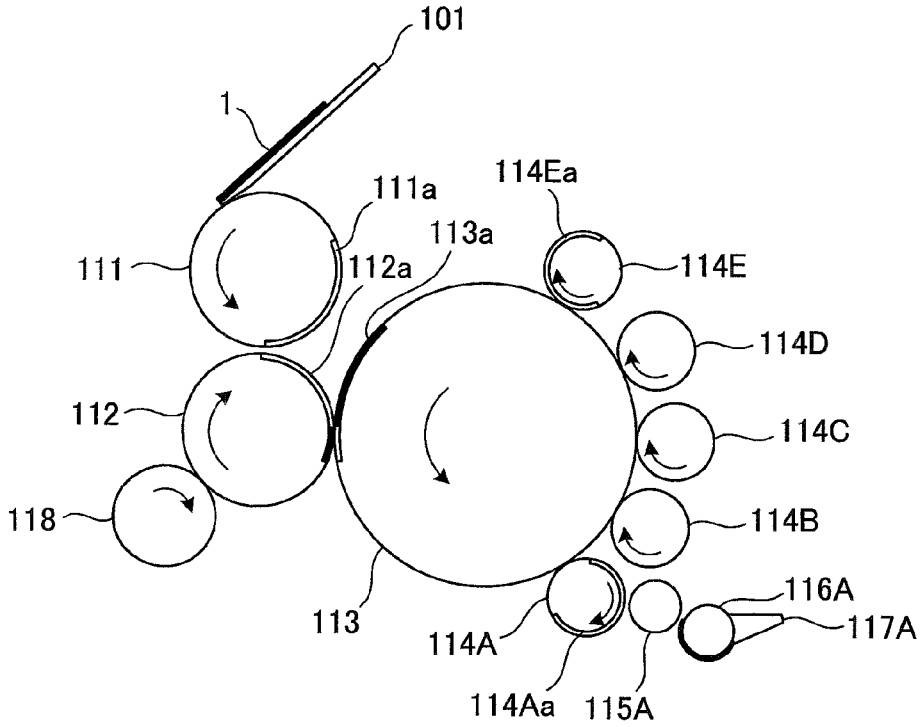
FIG. 3G shows a diagram for explaining the operation after FIG. 3F.
Figure 3H:
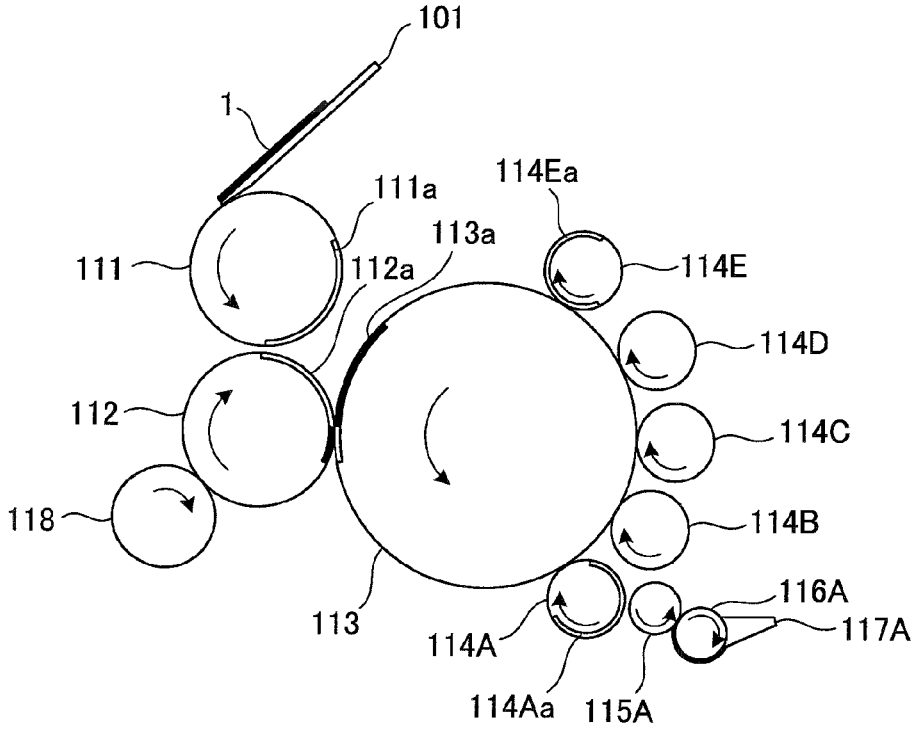
FIG. 3H shows a diagram for explaining the operation after FIG. 3G.
Figure 3I:
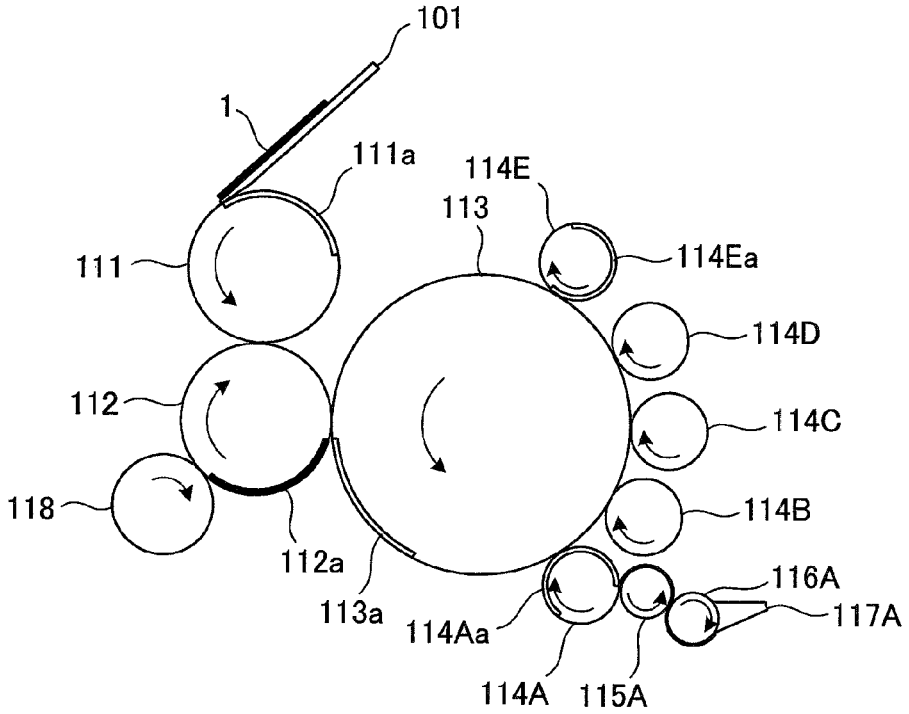
FIG. 3I shows a diagram for explaining the operation after FIG. 3H.
Figure 3J:
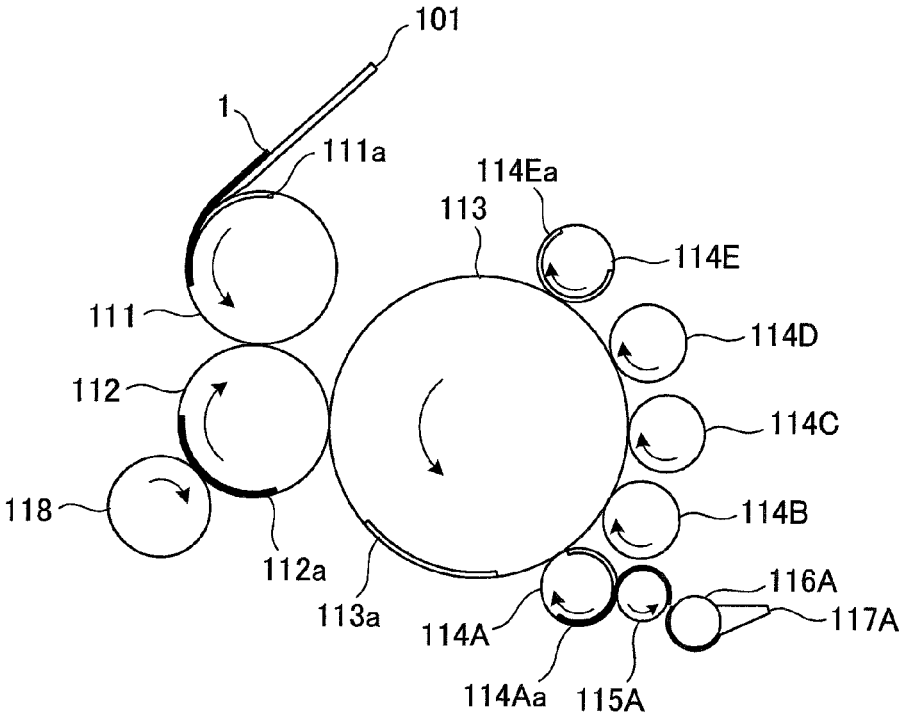
FIG. 3J shows a diagram for explaining the operation after FIG. 3I.

The rotation phases of the collecting cylinder 113 and the plate cylinder 112 are set such that when the mounting surfaces (working surfaces) 113*a* and 112*a* face each other in accordance with the rotations, the collecting cylinder 113 and the plate cylinder 112 rotate in synchronism and in contact with each other, in other words, the end portion at the downstream side in the rotation direction of the mounting surface (working surface) 113*a* of the collecting cylinder 113 and an end portion at a downstream side in a rotation direction of the mounting surface (working surface) 112*a* of the plate cylinder 112 rotate in synchronism and in contact with each other (see FIGS. 3G to 3I). Hence, the collecting cylinder 113 and the plate cylinder 112 are not in contact with each other unless the mounting surfaces (working surfaces) 113*a* and 112*a* face each other.

Figure 3K:
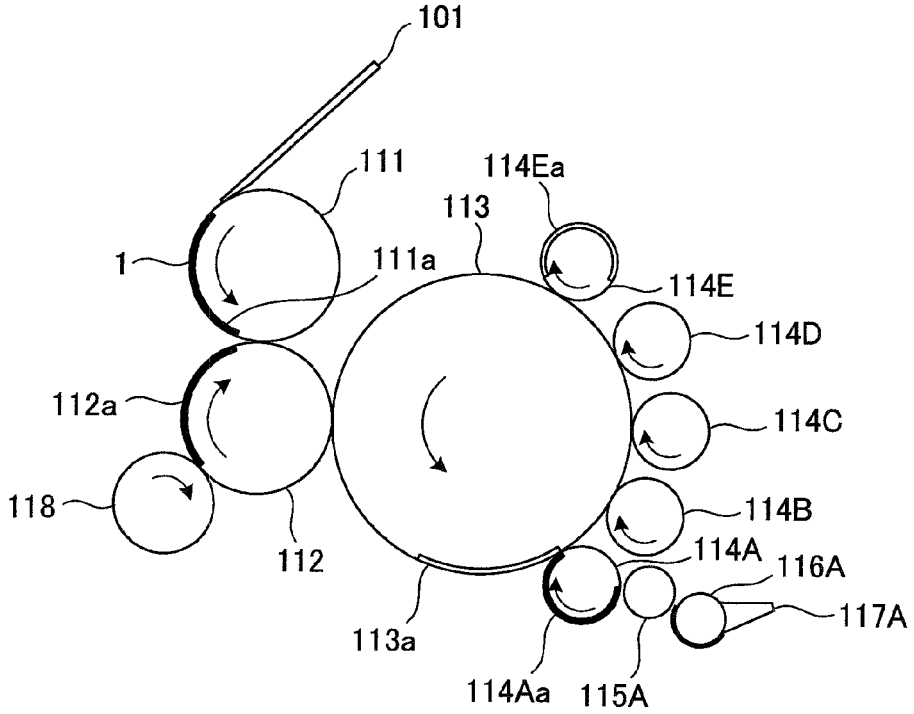
FIG. 3K shows a diagram for explaining the operation after FIG. 3J.
Figure 3L:
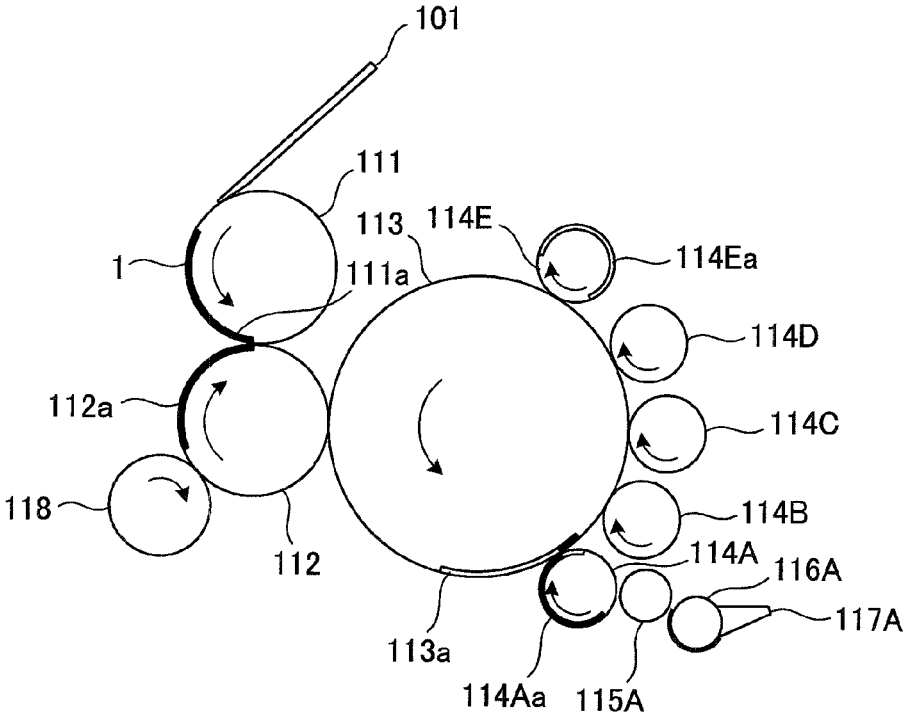
FIG. 3L shows a diagram for explaining the operation after FIG. 3K.

The rotation phase of the impression cylinder 111 is set such that when the impression cylinder 111 approaches the plate cylinder 112 and rotates, the holding surface (working surface) 111*a* is rotatable in synchronism and in contact with the mounting surface (working surface) 112*a* of the plate cylinder 112 (see FIG. 3L).

Moreover, the impression cylinder 111, the collecting cylinder 113, and the wiping roller 118 are positioned relative to the plate cylinder 112 such that a length L11 of the outer circumference of the plate cylinder 112 at the downstream side of the facing position P1 in the rotation direction of the plate cylinder 112 is longer than the length L2 of the mounting surface (working surface) 112*a* of the plate cylinder 112 (L11>L2), where the length L11 extends between the facing position P1 where the plate cylinder 112 faces the collecting cylinder 113 and a facing position P2 where the plate cylinder 112 faces the wiping roller 118, and that a length L12 of the outer circumference of the plate cylinder 112 at a downstream side of the facing position P2 in the rotation direction of the plate cylinder 112 is longer than the length L2 of the mounting surface (working surface) 112*a* of the plate cylinder 112 (L12>L2), where the length L12 extends between the facing position P2 and the facing position P3 where the plate cylinder 112 faces the impression cylinder 111.

Further, the chablon cylinders 114A located at the most upstream side of the facing position P1 in the rotation direction of the collecting cylinder 113 and the chablon cylinder 114E located at the most downstream side of the facing position P1 in the rotation direction of the collecting cylinder 113 as well as the other chablon cylinders 114B to 114D located between the chablon cylinders 114A and 114E are positioned relative to the collecting cylinder 113 such that a length L13 of the outer circumference of the collecting cylinder 113 at the downstream side of the facing position P1 in the rotation direction of the collecting cylinder 113 is longer than the length L3 of the mounting surface (working surface) 113*a* of the collecting cylinder 113 (L13>L3), where the length L13 extends between the facing position P1 and a facing position P4 where the collecting cylinder 113 faces the chablon cylinder 114A located at the most upstream side, and that a length L14 of the outer circumference of the collecting cylinder 113 at the upstream side of the facing position P1 in the rotation direction of the collecting cylinder 113 is longer than the length L3 of the mounting surface (working surface) 113*a* of the collecting cylinder 113 (L14>L3), where the length L14 extends between the facing position P1 and a facing position P5 where the collecting cylinder 113 faces the chablon cylinder 114E located at the most downstream side.

In addition, the sheet feed table 101 is positioned relative to the impression cylinder 111 such that a length L15 of the outer circumference of the impression cylinder 111 at a downstream side of a supplying position P6 in a rotation direction of the impression cylinder 111 is longer than the length L1 of the holding surface (working surface) 111*a* of the impression cylinder 111 (L15>L1), where the length L15 extends between the facing position P3 and the supplying position P6, the supplying position P6 is a position where the sheet 1 is supplied from the sheet feed table 101 to the holding surface (working surface) 111*a* of the impression cylinder 111, and that a length L16 of the outer circumference of the impression cylinder 111 at an upstream side of the supplying position P6 in the rotation direction of the impression cylinder 111 is longer than the length L1 of the holding surface (working surface) 111*a* of the impression cylinder 111 (L16>L1), where the length L16 extends between the facing position P3 and the supplying position P6.

Figure 2:
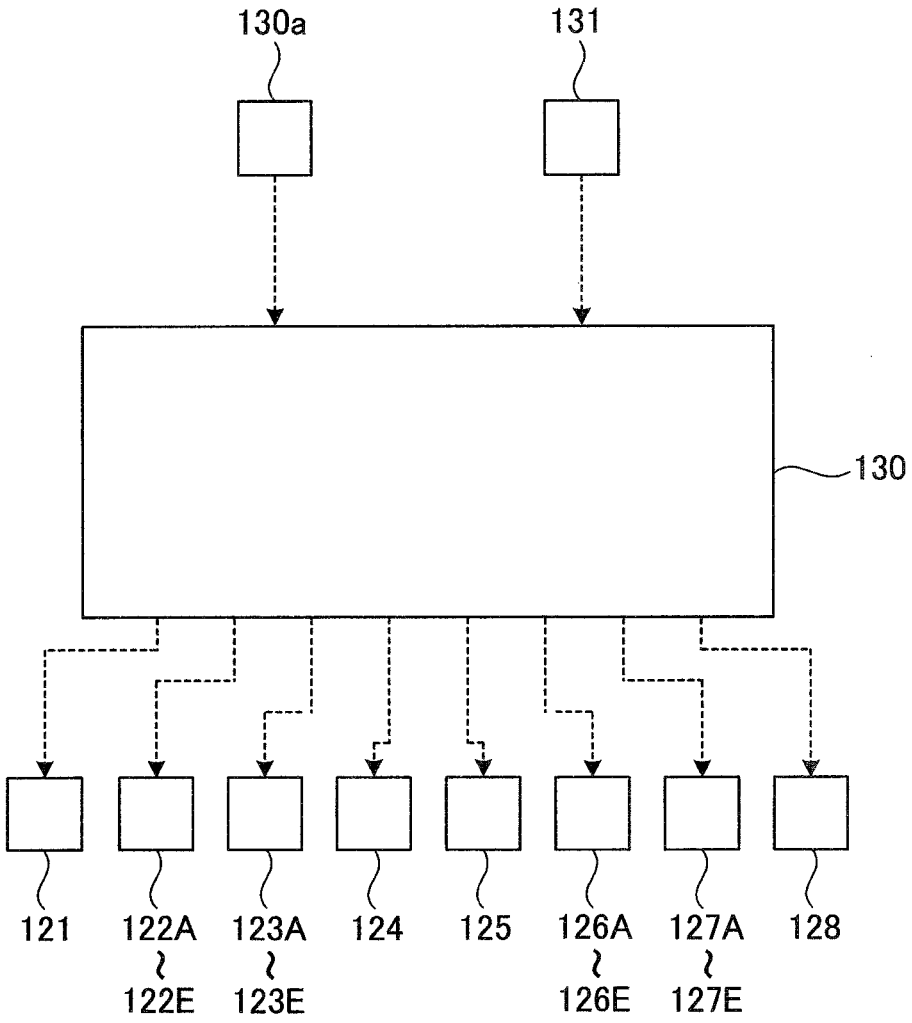
FIG. 2 shows a control block diagram of a principal part of the proof printing press shown in FIG. 1.

As shown in FIG. 2, the rotary encoder 131 is electrically connected to an input portion of the controller 130 that is controlling means. An output portion of the controller 130 is electrically connected to: a drive motor 121 configured to rotate the cylinders 111 to 113 and 114A to 114E; drive motors 122A to 122E that are form-roller-rotation driving means and configured to rotate the form rollers 115A to 115E; drive motors 123A to 123E that are fountain-roller-rotation driving means and configured to rotate the fountain rollers 116A to 116E; a drive motor 124 configured to rotate the wiping roller 118; an impression-cylinder throw-on/off device 125 that is impression-cylinder-throw-on/off driving means such as a pneumatic cylinder configured to rotate the eccentric bearing or the like in such a manner that the impression cylinder 111 is moved toward and away (thrown on/off) from the plate cylinder 112; ink-supplying throw-on/off devices 126A to 126E that are fountain-roller-throw-on/off driving means and configured to move the fountain rollers 116A to 116E and the ink fountains 117A to 117E in such a manner that the fountain rollers 116A to 116E are moved toward and away (thrown on/off) from the form rollers 115A to 115E; form-roller-throw-on/off devices 127A to 127E that are form-roller-throw-on/off driving means and configured to move the form rollers 115A to 115E in such a manner that the form rollers 115A to 115E are moved toward and away (thrown on/off) from the chablon cylinders 114A to 114E; and a feeder 128 of the sheet feed device configured to feed a sheet from the sheet feed table 101.

The input portion of the controller 130 is electrically connected to a printing operation start switch 130*a* configured to output a signal to start a printing operation. The controller 130 is capable of controlling operations of the motors 121, 122A to 122E, 123A to 123E, 124, the throw-on/off device 125, 126A to 126E, 127A to 127E, and the feeder 128 on the basis of signals from the switch 130*a* and the rotary encoder 131 (the details will be described later).

Note that, in the present embodiment, the fountain rollers 116A to 116E, the ink fountains 117A to 117E, and the like constitute multiple (five) ink supplying means; the wiping roller 118, the drive motor 124, and the like constitute wiping means; and the drive motor 121, the gear train, and the like constitute cylinder-rotation driving means.

Next, operations of the above-described proof printing press 100 according to the present embodiment will be described in line with FIGS. 3A to 3N. Note that, in order to avoid complication of the drawings, notations of the mounting surfaces (working surfaces) 114Ba to 114Da of the chablon cylinders 114B to 114D are omitted in FIGS. 3A to 3N, and notations of the form rollers 115B to 115E, the fountain rollers 116B to 116E, and the ink fountains 117B to 117E are omitted in FIGS. 3B to 3N.

In the proof printing press 100, initially, the impression cylinder 111 is located at a position away (thrown off) from the plate cylinder 112, the form rollers 115A to 115E are located at positions away (thrown off) from the chablon cylinders 114A to 114E, and the fountain rollers 116A to 116E are located at positions away (thrown off) from the form rollers 115A to 115E (see FIG. 3A).

Then, the sheet 1 is placed on the sheet feed table 101. When a signal to start a printing operation is outputted from the printing operation start switch 130*a* to the controller 130, the controller 130 controls the operation of the drive motor 121 in such a manner that the cylinders 111 to 113 and 114A to 114E are rotated in synchronism with one another, and controls the operation of the drive motor 124 in such a manner that the wiping roller 118 is rotated, on the basis of the signal from the printing operation start switch 130*a*.

Next, on the basis of information from the rotary encoder 131, the controller 130 controls the operations of the ink-supplying throw-on/off devices 126A to 126E in such a manner that the fountain rollers 116A to 116E are brought into contact with (thrown on) the form rollers 115A to 115E, and controls the operations of the drive motors 122A to 122E and 123A to 123E in such a manner that the fountain rollers 116A to 116E and the form rollers 115A to 115E are rotated (see FIG. 3B). Hence, when end portions at downstream sides in rotation directions of the mounting surfaces (working surfaces) 114Aa to 114Ea of the chablon cylinders 114A to 114E face the form rollers 115A to 115E, inks are supplied to outer circumferential surfaces of the form rollers 115A to 115E between upstream sides of positions facing the chablon cylinders 114A to 114E in the rotation directions of the form rollers 115A to 115E and downstream sides of positions facing the fountain rollers 116A to 116E in the rotation directions (see FIG. 3C).

Thereby, inks in the ink fountains 117A to 117E are extracted in accordance with the rotations of the fountain rollers 116A to 116E. The inks are supplied to the outer circumferential surfaces of the form rollers 115A to 115E.

Subsequently, when the end portions at the downstream sides in the rotation directions of the mounting surfaces (working surfaces) 114Aa to 114Ea of the chablon cylinders 114A to 114E face the form rollers 115A to 115E, the controller 130 controls the operations of the form-roller-throw-on/off devices 127A to 127E on the basis of information from the rotary encoder 131 in such a manner that the form rollers 115A to 115E are brought into contact with (thrown on) segment plates mounted on the mounting surfaces (working surfaces) 114Aa to 114Ea of the chablon cylinders 114A to 114E (see FIG. 3C).

This starts supplying initial portions of the inks having been supplied to the outer circumferential surfaces of the form rollers 115A to 115E, and the initial portions are then supplied from end portions at downstream sides in the rotation directions of the segment plates on the mounting surfaces (working surfaces) 114Aa to 114Ea of the chablon cylinders 114A to 114E.

In this manner, inks are supplied from the fountain rollers 116A to 116E via the form rollers 115A to 115E to the segment plates on the chablon cylinders 114A to 114E. After the inks are supplied over the entire lengths in the circumferential directions of the outer circumferential surfaces of the form rollers 115A to 115E, to put it differently, upon completion of one rotation after the form rollers 115A to 115E start being supplied with the inks from the fountain rollers 116A to 116E, the controller 130 controls the operations of the ink-supplying throw-on/off devices 126A to 126E in such a manner that the fountain rollers 116A to 116E are moved away (thrown off) from the form rollers 115A to 115E, and simultaneously controls the operations of the drive motors 123A to 123E in such a manner that the rotations of the fountain rollers 116A to 116E are stopped, on the basis of information from the rotary encoder 130 (see FIG. 3D).

Thereby, each outer circumferential surface of the form rollers 115A to 115E is supplied with ink in an amount corresponding to the length L4 of the mounting surfaces (working surfaces) 114Aa to 114Ea of the chablon cylinders 114A to 114E.

Then, after end portions at upstream sides in the rotation directions of the mounting surfaces (working surfaces) 114Aa to 114Ea of the chablon cylinders 114A to 114E face the form rollers 115A to 115E, to put it differently, upon completion of one rotation after the form rollers 115A to 115E are brought into contact with the segment plates on the mounting surfaces (working surfaces) 114Aa to 114Ea of the chablon cylinders 114A to 114E, the controller 130 controls the operations of the form-roller-throw-on/off devices 127A to 127E in such a manner that the form rollers 115A to 115E are moved away (thrown off) from the chablon cylinders 114A to 114E, and simultaneously controls the operations of the drive motors 122A to 122E in such a manner that the rotations of the form rollers 115A to 115E are stopped, on the basis of information from the rotary encoder 131 (see FIG. 3E).

Thereby, the inks having been supplied to the outer circumferential surfaces of the form rollers 115A to 115E are completely supplied over the entire lengths of the segment plates on the mounting surfaces (working surfaces) 114Aa to 114Ea of the chablon cylinders 114A to 114E.

In this manner, after the inks are supplied to the segment plates on the mounting surfaces (working surfaces) 114Aa to 114Ea of the chablon cylinders 114A to 114E, the inks are sequentially transferred to the blankets mounted on the mounting surface (working surface) 113*a* of the collecting cylinder 113 in accordance with the rotation of the collecting cylinder 113 (see FIG. 3F).

In this event, since the length L5 in the circumferential direction of the outer circumferential surfaces of the form rollers 115A to 115E is equal to the length L4 in the circumferential direction of the mounting surfaces (working surfaces) 114Aa to 114Ea of the chablon cylinders 114A to 114E (L5=L4) as described above, this makes it possible to facilitate supplying of the inks in a uniform thickness over the entire lengths of the segment plates on the chablon cylinders 114A to 114E from the form rollers 115A to 115E, and to uniformly transfer the inks to the blankets on the collecting cylinder 113 with a high precision.

In this manner, after the inks are transferred from all of the chablon cylinders 114A to 114E to the blankets on the collecting cylinder 113, the blankets on the collecting cylinder 113 are brought into contact with the intaglio printing plates mounted on the mounting surface (working surface) 112*a* of the plate cylinder 112 to transfer the inks (see FIG. 3G).

In this respect, while the inks are transferred from the blankets on the collecting cylinder 113 to the intaglio printing plates on the plate cylinder 112, the wiping roller is not in contact with the intaglio printing plates on the plate cylinder 112. Accordingly, it is possible to prevent a disturbance to the intaglio printing plates, so that the inks can be transferred evenly from the blankets to the intaglio printing plates.

Further, after all of the chablon cylinders 114A to 114E transfer the inks to the blankets on the collecting cylinder 113, the blankets on the collecting cylinder 113 transfer the inks to the intaglio printing plates on the plate cylinder 112. Accordingly, when the inks are transferred from the blankets on the collecting cylinder 113 to the intaglio printing plates on the plate cylinder 112, it is possible to prevent a disturbance to the blankets, and the inks can be transferred evenly from the blankets to the intaglio printing plates more reliably Next, on the basis of information from the rotary encoder 131, the controller 130 controls the operations of the ink-supplying throw-on/off devices 126A to 126E in such a manner that the fountain rollers 116A to 116E are brought into contact with (thrown on) the form rollers 115A to 115E again, and controls the operations of the drive motors 122A to 122E and 123A to 123E in such a manner that the fountain rollers 116A to 116E and the form rollers 115A to 115E are rotated again (see FIG. 3H). Hence, when the end portions at the downstream sides in the rotation directions of the mounting surfaces (working surfaces) 114Aa to 114Ea of the chablon cylinders 114A to 114E face the form rollers 115A to 115E again, inks are again supplied to the outer circumferential surfaces of the form rollers 115A to 115E between the upstream sides of the positions facing the chablon cylinders 114A to 114E in the rotation directions of the form rollers 115A to 115E and the downstream sides of the positions facing the fountain rollers 116A to 116E in the rotation directions (see FIG. 3I).

Subsequently, when the end portions at the downstream sides in the rotation directions of the mounting surfaces (working surfaces) 114Aa to 114Ea of the chablon cylinders 114A to 114E face the form rollers 115A to 115E again, the controller 130 controls the operations of the form-roller-throw-on/off devices 127A to 127E on the basis of information from the rotary encoder 131 in such a manner that the form rollers 115A to 115E are again brought into contact with (thrown on) the segment plates on the mounting surfaces (working surfaces) 114Aa to 114Ea of the chablon cylinders 114A to 114E (see FIG. 3I).

This starts supplying initial portions of the inks having been supplied to the outer circumferential surfaces of the form rollers 115A to 115E similarly to the above case, and the initial portions are then supplied from the end portions at the downstream sides in the rotation directions of the segment plates on the mounting surfaces (working surfaces) 114Aa to 114Ea of the chablon cylinders 114A to 114E.

On the other hand, after the inks on the blankets on the collecting cylinder 113 are transferred to the intaglio printing plates on the plate cylinder 112 (see FIG. 3I), the controller 130 controls the operation of the impression-cylinder throw-on/off device 125 in such a manner that the impression cylinder 111 is moved toward (thrown on) the plate cylinder 112, and controls the operation of the feeder 128 in such a manner that the sheet 1 on the sheet feed table 101 is fed to the impression cylinder 111, on the basis of information from the rotary encoder 131.

Thereby, a forward edge side (gripping side) of the sheet 1 on the sheet feed table 101 is gripped by the grip device of the impression cylinder 111 and thereby held on the holding surface (working surface) 111*a*. Moreover, the wiping roller 118 removes extra inks on the surfaces of the intaglio printing plates on the plate cylinder 112 (see FIG. 3J).

On the one hand, similarly to the above-described case, inks are supplied from the fountain rollers 116A to 116E via the form rollers 115A to 115E to the segment plates on the chablon cylinders 114A to 114E. After the inks are again supplied over the entire lengths in the circumferential directions of the outer circumferential surfaces of the form rollers 115A to 115E, to put it differently, upon completion of one rotation after the form rollers 115A to 115E again start being supplied with the inks from the fountain rollers 116A to 116E, the controller 130 controls the operations of the ink-supplying throw-on/off devices 126A to 126E in such a manner that the fountain rollers 116A to 116E are moved away (thrown off) from the form rollers 115A to 115E again, and simultaneously controls the operations of the drive motors 123A to 123E in such a manner that the rotations of the fountain rollers 116A to 116E are stopped again, on the basis of information from the rotary encoder 130 (see FIG. 3J).

Thereby, similarly to the above-described case, each outer circumferential surface of the form rollers 115A to 115E is again supplied with ink in an amount corresponding to the length L4 of the mounting surfaces (working surfaces) 114Aa to 114Ea of the chablon cylinders 114A to 114E.

Then, similarly to the above-described case, after the end portions at the upstream sides in the rotation directions of the mounting surfaces (working surfaces) 114Aa to 114Ea of the chablon cylinders 114A to 114E face the form rollers 115A to 115E again, to put it differently, upon completion of one rotation after the form rollers 115A to 115E are brought into contact with the segment plates on the mounting surfaces (working surfaces) 114Aa to 114Ea of the chablon cylinders 114A to 114E, the controller 130 controls the operations of the form-roller-throw-on/off devices 127A to 127E in such a manner that the chablon cylinders 114A to 114E are moved away (thrown off) from the form rollers 115A to 115E again, and simultaneously controls the operations of the drive motors 122A to 122E in such a manner that the rotations of the form rollers 115A to 115E are stopped again, on the basis of information from the rotary encoder 131 (see FIG. 3K).

Thereby, the inks having been supplied again to the outer circumferential surfaces of the form rollers 115A to 115E are completely supplied again over the entire lengths of the segment plates on the mounting surfaces (working surfaces) 114Aa to 114Ea of the chablon cylinders 114A to 114E.

Subsequently, similarly to the above-described case, after the inks are supplied again to the segment plates on the mounting surfaces (working surfaces) 114Aa to 114Ea of the chablon cylinders 114A to 114E, the inks are again sequentially transferred to the blankets on the mounting surface (working surface) 113*a* of the collecting cylinder 113 in accordance with the rotation of the collecting cylinder 113 (see FIGS. 3L to 3N).

In this event, as described above, since the length L5 in the circumferential direction of the outer circumferential surfaces of the form rollers 115A to 115E is equal to the length L4 in the circumferential direction of the mounting surfaces (working surfaces) 114Aa to 114Ea of the chablon cylinders 114A to 114E (L5=L4), this makes it possible to facilitate supplying of the inks in a uniform thickness over the entire lengths of the segment plates on the chablon cylinders 114A to 114E from the form rollers 115A to 115E, and to uniformly transfer the inks to the blankets on the collecting cylinder 113 with a high precision.

On the other hand, the sheet 1 is transported while being held over the entire surface of the holding surface (working surface) 111*a* of the impression cylinder 111, and the wiping roller 118 removes all the extra inks on the surfaces of the intaglio printing plates on the plate cylinder 112 (see FIG. 3K). After that, the sheet 1 on the holding surface (working surface) 111*a* of the impression cylinder 111 is brought into contact with the intaglio printing plates on the plate cylinder 112, so that the ink corresponding to a pattern on the intaglio printing plates is transferred to the sheet 1 (see FIG. 3L).

In this event, after the wiping roller 118 removes all the extra inks on the surfaces of the intaglio printing plates on the plate cylinder 112, the intaglio printing plates on the plate cylinder 112 come into contact with the sheet 1 transported while being held on the holding surface (working surface) 111*a* of the impression cylinder 111 to transfer the inks. Accordingly, it is possible to prevent a disturbance to the intaglio printing plates when the inks are transferred from the intaglio printing plates to the sheet 1, and the inks can be transferred evenly from the intaglio printing plates to the sheet 1.

Further, after the sheet 1 from the sheet feed table 101 is held over the entire surface of the holding surface (working surface) 111*a* of the impression cylinder 111, the intaglio printing plates on the plate cylinder 112 come into contact with the sheet 1 on the impression cylinder 111 to transfer the inks. Accordingly, it is possible to prevent a disturbance to the sheet 1 when the inks are transferred from the intaglio printing plates to the sheet 1, and the inks can be transferred evenly from the intaglio printing plates to the sheet 1 more reliably.

Figure 3M:
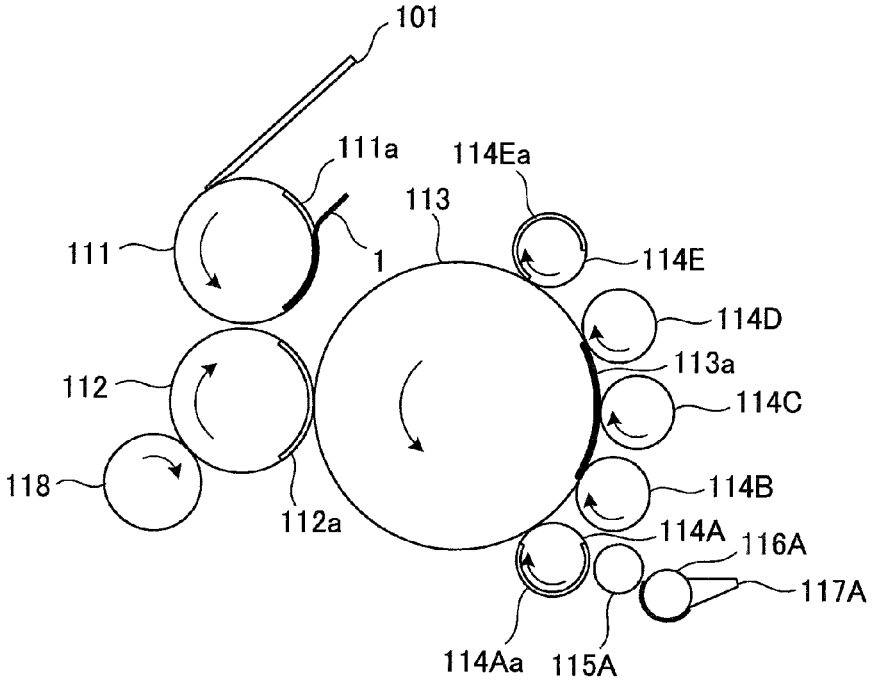
FIG. 3M shows a diagram for explaining the operation after FIG. 3L.

In this manner, after the inks are transferred from the intaglio printing plates on the plate cylinder 112 to the sheet 1 on the impression cylinder 111, the controller 130 controls the operation of the impression-cylinder throw-on/off device 125 on the basis of a signal from the rotary encoder 131 in such a manner that the impression cylinder 111 is moved away (thrown off) from the plate cylinder 112 (see FIG. 3M).

Figure 3N:
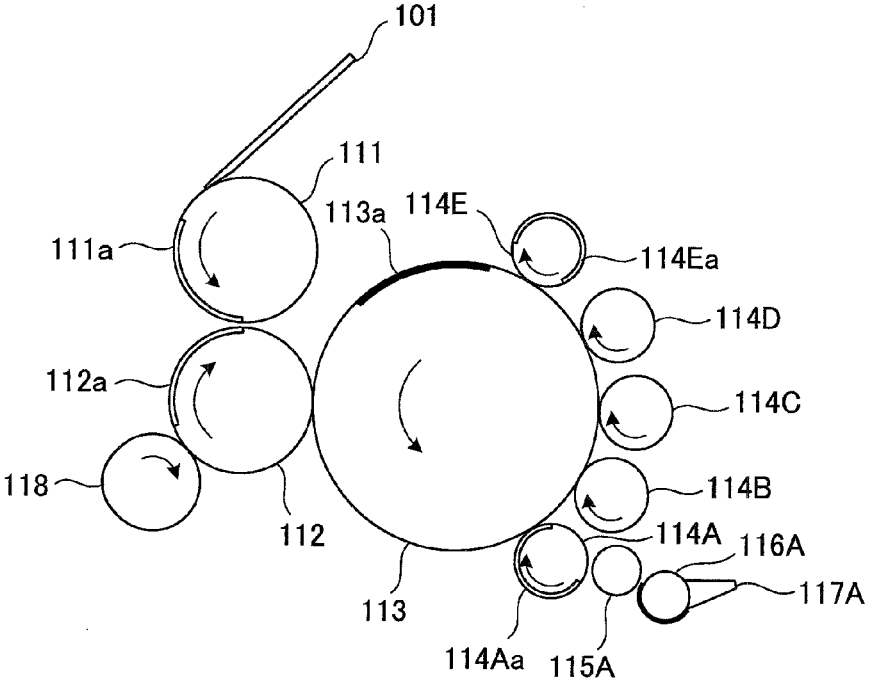
FIG. 3N shows a diagram for explaining the operation after FIG. 3M.

Thereby, the forward edge side (gripping side) of the sheet 1 held on the holding surface 111*a* of the impression cylinder 111 is released from the grip device, and the sheet 1 is collected from the holding surface 111*a* of the impression cylinder 111 (see FIG. 3N).

Thereafter, the operations shown in FIGS. 3F to 3N are repeated, so that proof printing can be performed continuously on a required number of sheets 1 with significantly reduced uneven transfer.

Thus, the proof printing press 100 according to the present embodiment is capable of significantly reducing printing failure.

Other Embodiments

Note that, in the above-described embodiment, the description has been given of the case of using the fountain rollers 116A to 116E having the length L6 in the circumferential direction of the outer circumferential surface, the length L6 being equal to the length L5 in the circumferential direction of the outer circumferential surfaces of the form rollers 115A to 115E (L6=L5). However, the same actions and effects as those in the above-described embodiment can be obtained even from, for example, a fountain roller having a length L6' in a circumferential direction of an outer circumferential surface thereof, the length L6' being longer than the length L5 in the circumferential direction of the outer circumferential surfaces of the form rollers 115A to 115E (L6'>L5), or a fountain roller having a length L6" in a circumferential direction of an outer circumferential surface thereof, the length L6" being shorter than the length L5 in the circumferential direction of the outer circumferential surfaces of the form rollers 115A to 115E (L6"<L5).

Moreover, in the above-described embodiment, when the fountain rollers 116A to 116E are moved away (thrown off) from the form rollers 115A to 115E, the rotations of the fountain rollers 116A to 116E are temporarily stopped. Nevertheless, in another embodiment, for example, even when the fountain rollers 116A to 116E are moved away (thrown off) from the form rollers 115A to 115E, the rotations of the fountain rollers 116A to 116E may be continued without stopping.

Further, in the above-described embodiment, the drive motors 122A to 122E configured to rotate the form rollers 115A to 115E and the drive motors 123A to 123E configured to rotate the fountain rollers 116A to 116E are independently provided. Nevertheless, in another embodiment, for example, the form rollers and the fountain rollers may be connected to the same drive motor via an electromagnetic clutch or the like, and a control may be performed on the operation to turn on and off the electromagnetic clutch or the like.

Furthermore, the drive motors 122A to 122E configured to rotate the form rollers 115A to 115E may be omitted, but the form rollers 115A to 115E are brought into contact with (thrown on) the fountain rollers 116A to 116E and the chablon cylinders 114A to 114E, so that the form rollers 115A to 115E can rotate automatically only in an manner accompanying the rotations of the fountain rollers 116A to 116E and the chablon cylinders 114A to 114E. In other words, the form-roller-rotation driving means may be constituted of the drive motor 121, the drive motors 123A to 123E, the ink-supplying throw-on/off devices 126A to 126E, the form-roller-throw-on/off devices 127A to 127E, and the like.

In this event, for example, form-roller-rotation braking means having a brake shoe or the like configured to stop the rotations of the form rollers 115A to 115E is provided. When the form rollers 115A to 115E are brought into contact with (thrown on) the fountain rollers 116A to 116E or the chablon cylinders 114A to 114E, the operation of the form-roller-rotation braking means may be controlled by the controlling means so that the form rollers 115A to 115E can rotate in a manner accompanying the rotations of the fountain rollers 116A to 116E or the chablon cylinders 114A to 114E. Meanwhile, when the form rollers 115A to 115E are moved away (thrown off) from the fountain rollers 116A to 116E or the chablon cylinders 114A to 114E, the operation of the form-roller-rotation braking means may be controlled by the controlling means so that the rotations of the form rollers 115A to 115E are stopped quickly.

Additionally, in the above-described embodiment, the fountain rollers 116A to 116E and the ink fountains 117A to 117E are movable toward and away (thrown on/off) from the form rollers 115A to 115E by the ink-supplying throw-on/off devices 126A to 126E, while the form rollers 115A to 115E are movable toward and away (thrown on/off) from the chablon cylinders 114A to 114E by the form-roller-throw-on/off devices 127A to 127E. Nevertheless, in another embodiment, for example, the form roller can be configured to be movable toward and away (thrown on/off) from each of the fountain roller and the chablon cylinder by the form-roller-throw-on/off driving means.

Moreover, in the above-described embodiment, the description has been given of the case of using the rotary encoder 131 provided to the plate cylinder 112, the rotary encoder 131 serving as the phase detecting means for detecting a rotation phase of the plate cylinder 112, in other words, detecting rotation phases of the cylinders 111 to 113 and 114A to 114E, to put it differently, detecting a phase of the printing press. However, in another embodiment, for example, a photosensor or the like may be disposed to face the outer circumferential surface of the collecting cylinder 113 or the plate cylinder 112 so as to constitute position detecting means for detecting a rotation direction position of the mounting surface (working surface) 113*a* of the collecting cylinder 113 or a rotation direction position of the mounting surface (working surface) 112*a* of the plate cylinder 112, so that ink supply from the ink supplying means can be controlled.

In this respect, suppose a case, for example, where the sheet feed device including the sheet feed table 101, the feeder 128, and the like is substituted with a sheet feed device configured to sequentially send multiple sheets stacked on a paper feed tray onto a feeder board and feed the sheets one by one to an impression cylinder using a swing arm shaft pregripper. In this case, as another embodiment, for example, the photosensor or the like may be disposed on and face the feeder board so as to constitute position detecting means for detecting a position of a sheet fed to the impression cylinder, so that ink supply from ink supplying means can be controlled.

Further, in the above-described embodiment, the impression cylinder 111, the plate cylinder 112, the collecting cylinder 113, and the chablon cylinders 114A to 114E are connected to one another via the gear train in such a manner as to be rotatable in synchronism with one another by the operation of the drive motor 121. Nevertheless, in another embodiment, for example, drive motors may be connected respectively to the cylinders 111 to 113 and 114A to 114E, and the operations of these drive motors may be controlled in synchronism with one another by the controlling means in such a manner that the cylinders 111 to 113 and 114A to 114E can rotate in synchronism with one another.

Furthermore, in the above-described embodiment, the description has been given of the proof printing press 100 in which the impression cylinder 111 and the plate cylinder 112 are double-size cylinders, while the collecting cylinder 113 is a quadruple-size cylinder. Nevertheless, in another embodiment, for example, the impression cylinder, the plate cylinder, and the collecting cylinder may be cylinders of the same size.

INDUSTRIAL APPLICABILITY

The proof printing press according to the present invention is capable of reducing uneven transfer onto a sheet and thereby reducing printing failure, and therefore is quite beneficially usable in the printing industry.

REFERENCE SIGNS LIST

1 SHEET
100 PROOF PRINTING PRESS
101 SHEET FEED TABLE
111 IMPRESSION CYLINDER
**111*a*** HOLDING SURFACE (WORKING SURFACE)
112 PLATE CYLINDER
**112*a*** MOUNTING SURFACE (WORKING SURFACE)
113 COLLECTING CYLINDER
**113*a*** MOUNTING SURFACE (WORKING SURFACE)
114A to 114E CHABLON CYLINDER
114Aa to 114Ea MOUNTING SURFACE (WORKING SURFACE)
115A to 115E FORM ROLLER
116A to 116E FOUNTAIN ROLLER
117A to 117E INK FOUNTAIN
118 WIPING ROLLER
121, 122A to 122E, 123A to 123E, 124 DRIVE MOTOR
125 IMPRESSION-CYLINDER THROW-ON/OFF DEVICE
126A to 126E INK-SUPPLYING THROW-ON/OFF DEVICE
127A to 127E FORM-ROLLER-THROW-ON/OFF DEVICE
128 FEEDER
130 CONTROLLER
**130*a*** PRINTING OPERATION START SWITCH
131 ROTARY ENCODER

The invention claimed is:

1. A proof printing press comprising:
a blanket;
segment plates;
a plate cylinder rotatably supported and including, on an outer circumference thereof, a working surface;
an intaglio printing plate mounted on the working surface of the plate cylinder;
an impression cylinder rotatably supported to face the plate cylinder and including, on an outer circumference thereof, a working surface configured to hold a sheet;
a collecting cylinder rotatably supported to face the plate cylinder and including, on an outer circumference thereof, a working surface on which the blanket is mounted;
a plurality of chablon cylinders disposed along a circumferential direction of the collecting cylinder, rotatably supported to face the collecting cylinder, and including, on outer circumferences thereof, working surfaces on which the segment plates are mounted;

a plurality of form rollers rotatably supported to face the chablon cylinders, respectively;

a plurality of ink supplying means for supplying inks to the form rollers, respectively; and wiping means disposed to face the plate cylinder between a downstream side of a facing position, where the plate cylinder faces the collecting cylinder, in a rotation direction of the plate cylinder and an upstream side of a facing position, where the plate cylinder faces the impression cylinder, in the rotation direction of the plate cylinder, the wiping means removing ink on a surface of the intaglio printing plate of the plate cylinder, wherein the plate cylinder, being a multiple-size cylinder, configured to mount thereon a plurality of the intaglio printing plates aligned in the circumferential direction, while the number of the working surface is only one, each of the chablon cylinders is a single-size cylinder, each of the chablon cylinders has a diameter such that the chablon cylinder rotates a plurality of times, while the plate cylinder rotates once, the impression cylinder, the collecting cylinder, and the wiping means are positioned relative to the plate cylinder such that a length of the outer circumference of the plate cylinder between a facing position P1, where the plate cylinder faces the collecting cylinder, and a facing position P2, where the plate cylinder faces the wiping means, in a downstream side of the facing position P1 in a rotation direction of the plate cylinder, is longer than a length in a circumferential direction of the working surface of the plate cylinder, and a length of the outer circumference of the plate cylinder between the facing position P2 and a facing position P3, where the plate cylinder faces the impression cylinder, at a downstream side of the facing position 2 in the rotation direction of the plate cylinder, is longer than the length in the circumferential direction of the working surface of the plate cylinder, and a length in a circumferential direction of outer circumferential surfaces of the form rollers is equal to a length in a circumferential direction of the working surfaces of the chablon cylinders, and the proof printing press further comprising:

a controller that sets rotation phases of the collecting cylinder and the chablon cylinders such that an end portion at a downstream side in a rotation direction of the working surface of the collecting cylinder and an end portion at a downstream side in a rotation direction of each of the working surfaces of the chablon cylinders rotate in synchronism and in contact with each other in accordance with rotations of the collecting cylinder and the chablon cylinders.

2. The proof printing press according to claim 1, wherein the plurality of chablon cylinders include five chablon cylinders disposed along the circumferential direction of the collecting cylinder, and the chablon cylinders are positioned such that a length of the outer circumference of the collecting cylinder between the facing position P1 and a facing position P4, where the collecting cylinder faces the chablon cylinder located at the most upstream side of the facing position P1 in the rotation direction of the collecting cylinder, at the downstream side of the facing position P1 in the rotation direction of the collecting cylinder, is longer than a length in the circumferential direction of the working surface of the collecting cylinder, and a length of the outer circumference of the collecting cylinder between the facing position P1 and a facing position P5, where the collecting cylinder faces the chablon cylinder located at the most downstream side of the facing position P1 in the rotation direction of the collecting cylinder, at an upstream side of the facing position P1 in the rotation direction of the collecting cylinder, is longer than the length in the circumferential direction of the working surface of the collecting cylinder.

3. The proof printing press according to claim 1, further comprising:

at least one detecting means of position detecting means for detecting at least one position of a rotation direction position of the working surface of the plate cylinder, a rotation direction position of the working surface of the collecting cylinder, and a position of the sheet fed to the impression cylinder, and phase detecting means for detecting a phase of the printing press, wherein the controller controls ink supply from the ink supplying means on basis of information from the detecting means in such a manner that when the end portions at the downstream sides in the rotation directions of the working surfaces of the chablon cylinders face the form rollers, the inks are supplied to the outer circumferential surfaces of the form rollers between upstream sides of positions facing the chablon cylinders in rotation directions of the form rollers and downstream sides of ink supply positions from the ink supplying means in the rotation directions of the form rollers.

4. The proof printing press according to claim 3, wherein the form rollers are supported in such a manner as to be movable toward and away from the chablon cylinders, and the ink supplying means include fountain rollers rotatably supported in such a manner as to be movable toward and away from the form rollers and configured to supply inks in ink fountains to the form rollers, wherein the proof printing press further comprises:

form-roller-rotation driving means for rotating the form rollers;

form-roller-throw-on/off driving means for moving the form rollers toward and away from the chablon cylinders;

fountain-roller-rotation driving means for rotating the fountain rollers; and fountain-roller-throw-on/off driving means for moving the fountain rollers toward and away from the form rollers, the detecting means includes at least the phase detecting means, and the controller controls the fountain-roller-throw-on/off driving means in such a manner that the fountain rollers are brought into contact with the form rollers, and controls the form-roller-rotation driving means and the fountain-roller-rotation driving means to rotate the fountain rollers and the form rollers, on the basis of information from the phase detecting means, so that when the end portions at the downstream sides in the rotation directions of the working surfaces of the chablon cylinders face the form rollers, inks are supplied to the outer circumferential surfaces of the form rollers between the upstream sides of the positions facing the chablon cylinders in the rotation directions of the form rollers and downstream sides of positions facing the fountain rollers in the rotation directions of the form rollers, controls the form-roller-throw-on/off driving means in such a manner that the form rollers are brought into contact with the segment plates on the working surfaces of the chablon cylinders, on the basis of information from the phase detecting means when the end portions at the downstream sides in the rotation directions of the working surfaces of the chablon cylinders face the form rollers, controls the fountain-roller-throw-on/off driving means in such a manner that the fountain rollers are moved away from the form rollers, on the basis of information from the phase detecting means upon completion of one rotation of the form rollers after the form rollers start being supplied with the inks, and controls the form-roller-throw-on/off driving means in such a manner that the form rollers are moved away from the chablon cylinders, and simultaneously controls the form-roller-rotation driving means in such a manner that the rotations of the form rollers are stopped, on the basis of information from the phase detecting means upon completion of one rotation after the form rollers are brought into contact with the segment plates on the working surfaces of the chablon cylinders.

5. The proof printing press according to claim 4, further comprising:

sheet feeding means for feeding the sheet to the impression cylinder, wherein the controller controls the sheet feeding means in such a manner that the sheet is fed to the impression cylinder, on the basis of information from the phase detecting means after the inks are transferred from the chablon cylinders to the blanket on the collecting cylinder and the inks are transferred from the blanket on the collecting cylinder to the intaglio printing plates on the working surface of the plate cylinder.

6. The proof printing press according to claim 5, wherein the controller controls the fountain-roller-throw-on/off driving means in such a manner that the fountain rollers are brought into contact with the form rollers again, and controls the form-roller-rotation driving means and the fountain-roller-rotation driving means to rotate the fountain rollers and the form rollers again, on the basis of information from the phase detecting means, so that when the inks transferred from the chablon cylinders to the blanket on the collecting cylinder are completely transferred from the blanket on the collecting cylinder to the intaglio printing plates on the working surface of the plate cylinder and then the end portions at the downstream sides in the rotation directions of the working surfaces of the chablon cylinders face the form rollers again, inks are again supplied to the outer circumferential surfaces of the form rollers between the upstream sides of the positions facing the chablon cylinders in the rotation directions of the form rollers and the downstream sides of the positions facing the fountain rollers in the rotation directions of the form rollers, controls the form-roller-throw-on/off driving means in such a manner that the form rollers are again brought into contact with the segment plates on the working surfaces of the chablon cylinders, on the basis of information from the phase detecting means when the end portions at the downstream sides in the rotation directions of the working surfaces of the chablon cylinders face the form rollers, controls the fountain-roller-throw-on/off driving means in such a manner that the fountain rollers are moved away from the form rollers again, on the basis of information from the phase detecting means upon completion of one rotation of the form rollers after the form rollers again starts being supplied with the inks, and controls the form-roller-throw-on/off driving means in such a manner that the form rollers are moved away from the chablon cylinders again, and simultaneously controls the form-roller-rotation driving means in such a manner that the rotations of the form rollers are stopped again, on the basis of information from the phase detecting means upon completion of one rotation after the form rollers are again brought into contact with the segment plates on the working surfaces of the chablon cylinders.

* * * * *